US007399186B2

(12) United States Patent
Tsai

(10) Patent No.: US 7,399,186 B2
(45) Date of Patent: Jul. 15, 2008

(54) MULTI-CARD CONNECTOR ASSEMBLY HAVING A MODULARIZED AND FLEXIBLE CONNECTION INTERFACE

(76) Inventor: Chou Hsuan Tsai, 15F, No. 4, Lane 127, Sec. 1, Fu-Hsing Rd., Hsin-Chuang City, Taipei Hsien (TW)

( * ) Notice: Subject to any disclaimer, the term of this patent is extended or adjusted under 35 U.S.C. 154(b) by 0 days.

(21) Appl. No.: 11/644,356

(22) Filed: Dec. 22, 2006

(65) Prior Publication Data

US 2007/0105447 A1 May 10, 2007

Related U.S. Application Data

(63) Continuation-in-part of application No. 11/029,113, filed on Dec. 31, 2004, now Pat. No. 7,175,477.

(51) Int. Cl.
*H01R 12/00* (2006.01)

(52) U.S. Cl. ..... 439/74

(58) Field of Classification Search ..... 439/629–632, 439/259–267, 159, 59, 62, 76, 77, 67, 108, 439/74, 541.5, 492–499, 76.1; 361/737, 361/728, 752, 796

See application file for complete search history.

(56) References Cited

U.S. PATENT DOCUMENTS 4,894,015 A * 1/1990 Stockero et al. ..... 439/67
5,123,851 A * 6/1992 Young et al. ..... 439/67
5,548,484 A * 8/1996 Kantner ..... 361/737
5,947,764 A * 9/1999 Pan et al. ..... 439/492
6,176,734 B1 * 1/2001 Juntwait et al. ..... 439/493
6,551,131 B1 * 4/2003 Kuo ..... 439/541.5
2005/0048810 A1 * 3/2005 Howie et al. ..... 439/67

* cited by examiner

*Primary Examiner*—Edwin A León
(74) *Attorney, Agent, or Firm*—Pro-Techtor Int'l Services

(57) ABSTRACT

A multi-card connector assembly includes a mainboard on which a mainboard connector is disposed, a multi-card connector, and a circuit board, on which traces and a connection interface are formed. The multi-card connector includes a common seat formed with a plurality of slots into which different electrical cards may be inserted, and terminals disposed on the common seat. Each terminal has a pin extending out of a bottom surface of the common seat. Each trace has a first terminal and a second terminal, which are disposed on a plane of the circuit board. The first terminals of the traces are arranged in correspondence with the pins of the terminals of the multi-card connector such that the pins of the terminals are respectively soldered to the first terminals of the traces. The connection interface is electrically connected to the second terminals of the traces and is flexibly and electrically connected to the mainboard connector.

15 Claims, 13 Drawing Sheets

MULTI-CARD CONNECTOR ASSEMBLY HAVING A MODULARIZED AND FLEXIBLE CONNECTION INTERFACE

CROSS-REFERENCE TO RELATED APPLICATIONS

This application is a continuation in part of, and claims priority under 35 U.S.C. § 120 from, nonprovisional U.S. patent application Ser. No. 11/029,113 entitled "Multi-Card Connector Assembly Having A Modularized And Flexible Connection Interface," filed on Dec. 31, 2004 now U.S. Pat. No. 7,175,477, the subject matter of which is incorporated herein by reference.

BACKGROUND OF THE INVENTION

1. Field of the Invention

The invention relates to an electrical connector assembly, and more particularly to a multi-card connector assembly capable of being connected to multiple types of electrical cards.

2. Description of the Related Art

Electrical cards for computers include multimedia storage cards or memory cards. The available memory cards, such as the Secure Digital Card (SDC), MultiMedia Card (MMC), Smart Media Card (SMC), Memory Stick Card (MSC), XD-picture card (XDC), and the like, in the market have various specifications. Because the positions of connection points of the memory cards with different specifications are not the same, electrical connectors to be connected to the memory cards with different specifications are not the same.

In order to facilitate the usage, the manufacturers try to integrate different electrical connectors into an electrical connector assembly suitable for various memory cards with various specifications. Because the assembly has to match with various memory cards with various specifications, the integrated multi-card connector must have various terminals corresponding to the memory cards with different specifications. Thus, the number of terminals is very large, and the pins of terminals cannot be ensured to be completely smooth.

As shown in FIG. 1, an multi-card electrical connector assembly suitable for multiple cards such as SDC, MMC, SMC, MSC, and XDC has a plurality of terminals. The pins 11 of the terminals extend out of the lateral side of the bottom surface of the base 12. The pins 11 cannot be kept smooth unless the assembly is precisely manufactured. In addition, the miss of soldering cannot be completely eliminated when the assembly is soldered to the mainboard of the electrical product.

Because the multi-card connector assembly cannot be easily soldered to the mainboard, the following drawbacks exist in the usage state.

1. The multi-card connector assembly has to be soldered to the mainboard under a high temperature condition, so the miss of soldering may be caused or the thermal shock may influence the assembly.

2. It is complicated to solder the multi-card connector assembly and then test the function of the assembly, and the assembly cannot be easily repaired and soldered again when the miss of soldering is found.

3. When the downstream manufacturer has found the second drawback, the downstream manufacturer will doubt the manufacturing quality of the multi-card connector assembly, or even stop the order. Thus, the upstream manufacturer may have a large loss. Even though the product has no defect in the upstream manufacturer and the defect is produced in the board-soldering process in the downstream manufacturer, the downstream manufacturer also may think that the defect is produced in the upstream manufacturer.

SUMMARY OF THE INVENTION

It is therefore an object of the invention to provide a multi-card connector assembly having a modularized and flexible connection interface, wherein a multi-card connector is soldered to a printed circuit board to form a modularized connection interface, which may be flexibly and electrically connected to an external interface and thus to a mainboard of a corresponding electrical product. Thus, the mainboard manufacturer does not need to perform the board-soldering process, and the influences of the miss of soldering or the thermal shock produced in the board-soldering process may be avoided.

Another object of the invention is to provide a multi-card connector assembly having a modularized and flexible connection interface of a flexible printed circuit cable to achieve the precise flexible electrical connection to an external interface without occupying too much space.

Still another object of the invention is to provide a multi-card connector assembly having a modularized and flexible connection interface of a flexible printed circuit cable to achieve the flexible electrical connection to an external interface without being soldered to another connector.

Yet still another object of the invention is to provide a multi-card connector assembly having a modularized and flexible connection interface, wherein the assembly has a flexible printed circuit board integrally formed with a connection interface of a flexible printed circuit cable and traces for connecting the flexible printed circuit board to the connection interface. Thus, the connection interface of the flexible printed circuit cable can be achieved without the need of being soldered to another printed circuit board, and the manufacturing cost may be reduced.

To achieve the above-mentioned objects, the multi-card connector assembly of the invention includes a mainboard, a multi-card connector and a circuit board. A mainboard connector is disposed on the mainboard. The multi-card connector includes a common seat formed with a plurality of slots into which different electrical cards may be inserted, and a plurality of terminals disposed on the common seat. Each of the terminals has a pin extending out of a bottom surface of the common seat. A plurality of traces and a connection interface are formed on the circuit board. Each of the traces has a first terminal and a second terminal, both of which are disposed on a plane of the circuit board. The first terminals of the traces are arranged in correspondence with the pins of the terminals of the multi-card connector such that the pins of the terminals are respectively soldered to the first terminals of the traces when the bottom surface of the common seat contacts the circuit board. The connection interface is electrically connected to the second terminals of the traces and may be flexibly and electrically connected to the mainboard connector.

According to the above-mentioned structure, the invention can provide a multi-card connector having a modularized and flexible connection interface to be flexibly and electrically connected to a mainboard connector disposed on a mainboard.

Furthermore, the connection interface may be a flexible printed circuit cable capable of achieving the flexible electrical connection to the external interface conveniently and precisely according to the connection interface of the flexible printed circuit cable without being soldering to another connector.

DETAILED DESCRIPTION OF THE INVENTION

Figure 1:
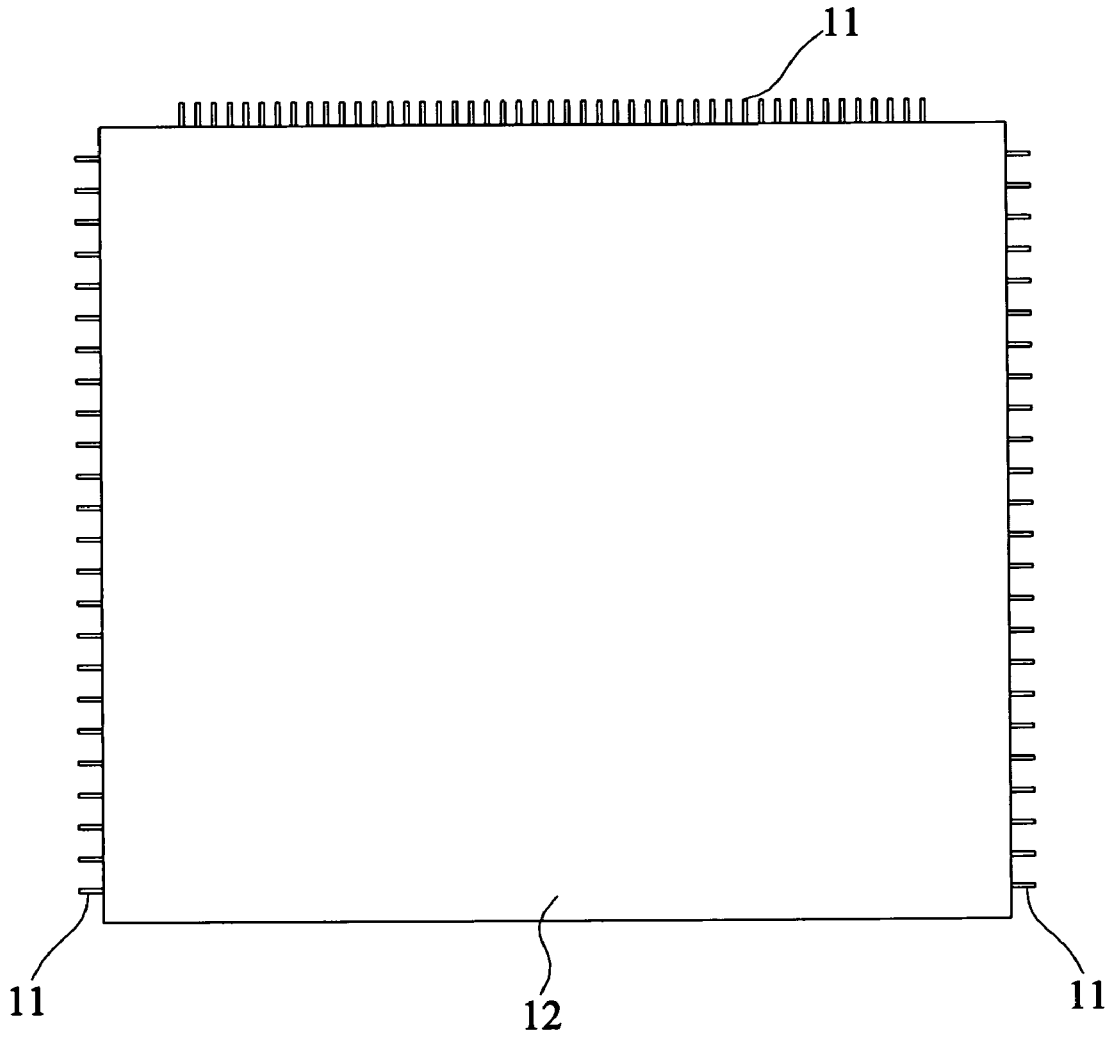
FIG. 1 (Prior Art)
FIG. 1 is a schematic top view showing a conventional multi-card connector.
Figure 2:
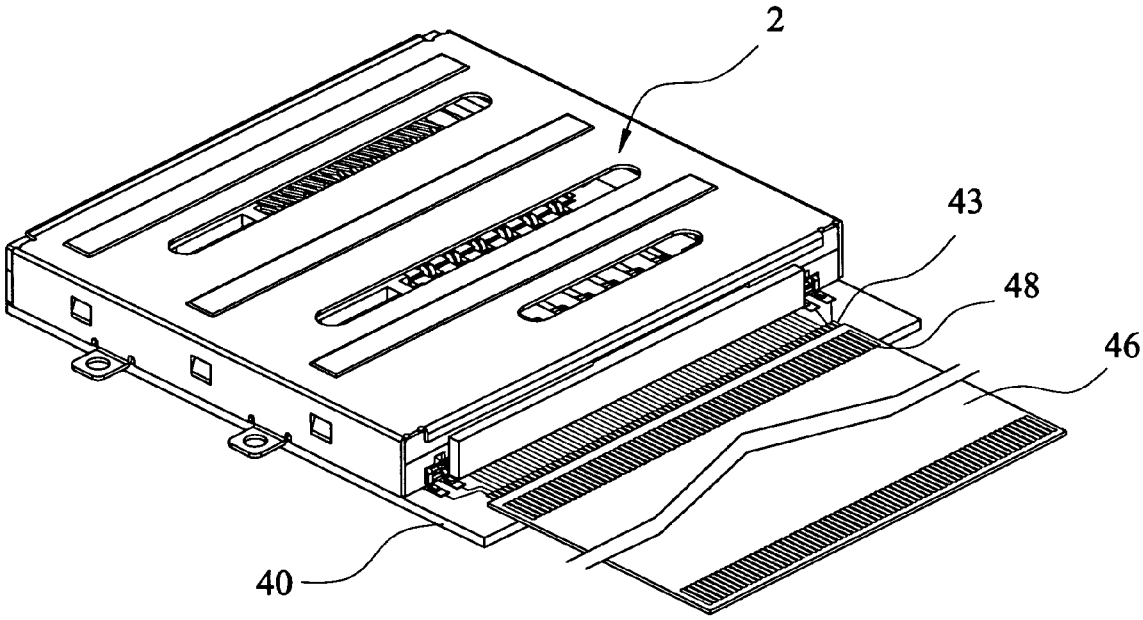
FIG. 2 is a pictorially assembled view showing a multi-card connector assembly according to a first embodiment of the invention.
Figure 3:
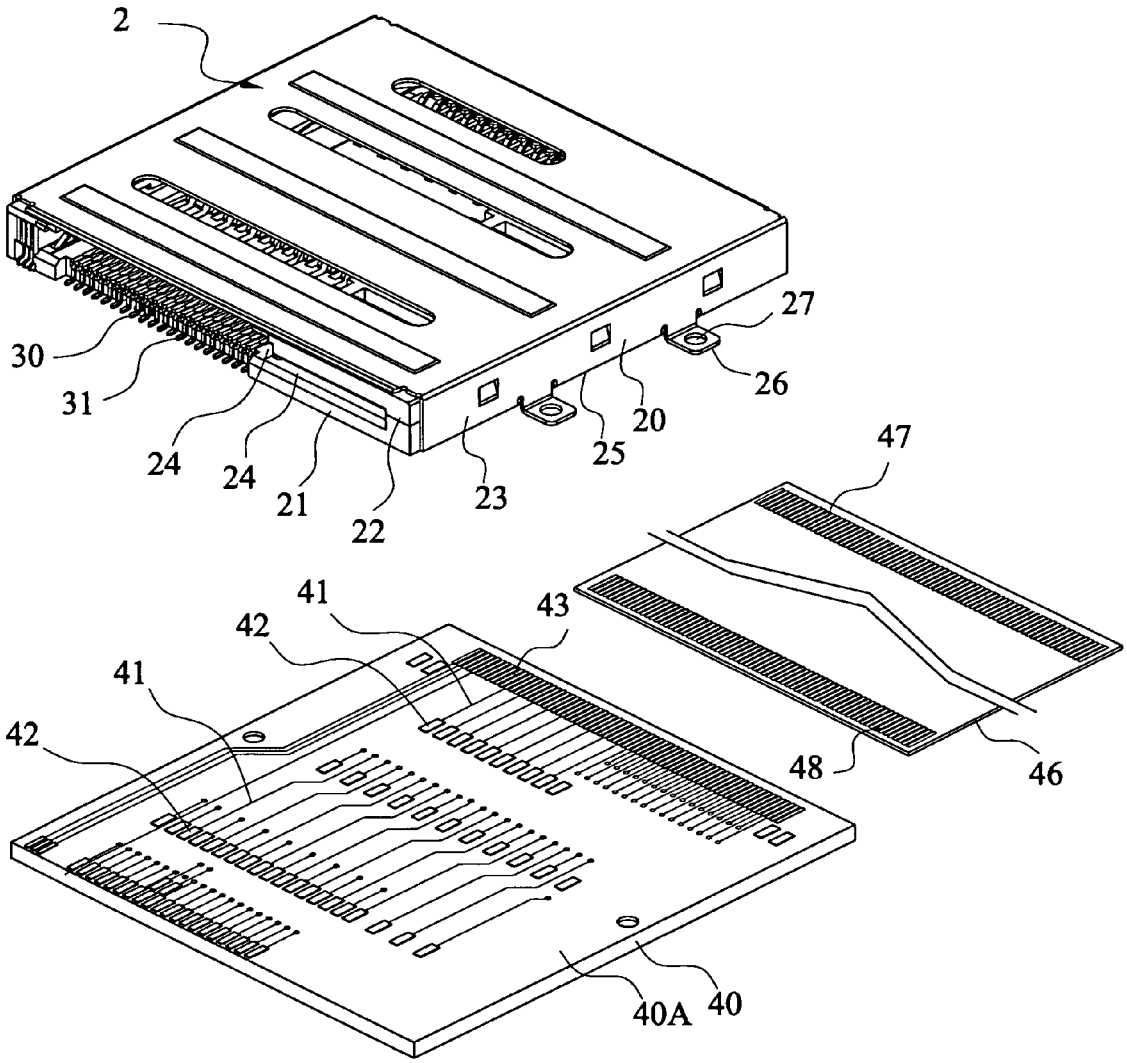
FIG. 3 is a pictorially exploded view showing the multi-card connector assembly according to the first embodiment of the invention.
Figure 4:
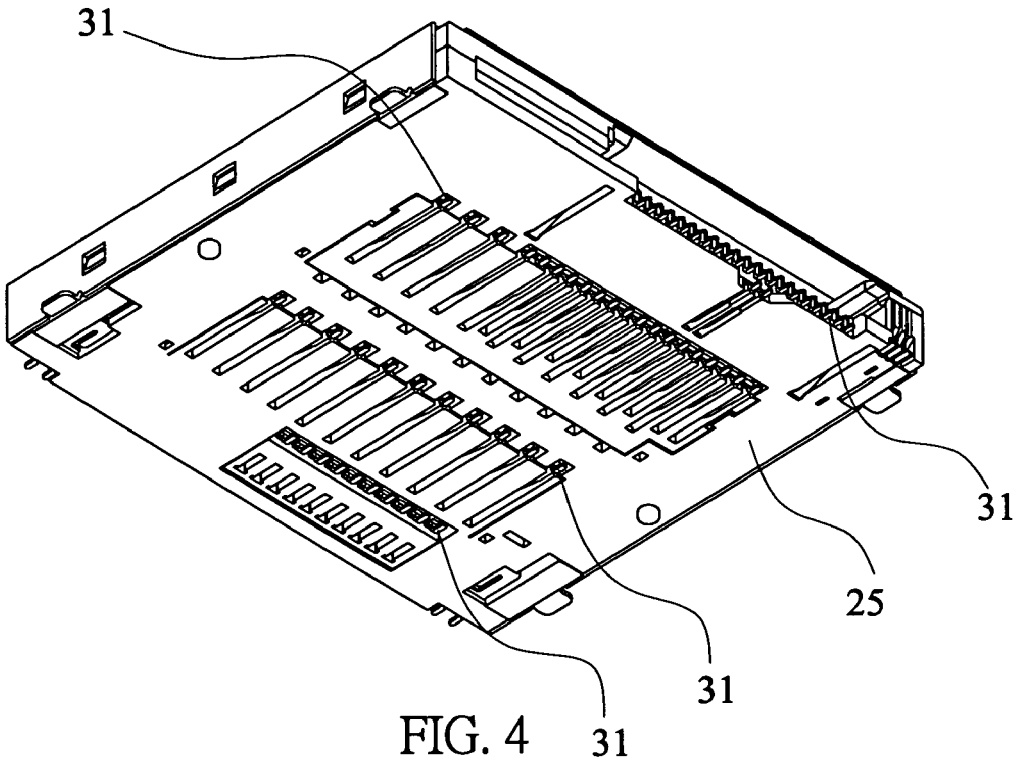
FIG. 4 is a pictorial bottom view showing the multi-card connector assembly according to the first embodiment of the invention.

Referring to FIGS. 2 to 4, the multi-card connector assembly includes a multi-card connector 2 and a circuit board 40.

The multi-card connector 2 includes a common seat 20 and a plurality of terminals 30. The common seat 20 is composed of a base 21, a middle board 22 and an upper cover 23 to form a plurality of slots 24 into which different electrical cards may be inserted. The base 21 made of a plastic material has a bottom surface 25. The middle board 22 made of a plastic material is disposed on the base 21. The upper cover 23 is an inverse U-shaped metal housing covering over the middle board 22 and is fastened to the base 21. The upper cover 23 has two fixing portions 26 at bottom ends on two sides thereof. The fixing portion 26 is a horizontal plate formed with a through hole 27 through which a screw may pass. The terminals 30 are disposed on the common seat 20. Each of the terminals 30 has a pin 31 extending out of the bottom surface 25 of the base 21 of the common seat. The pins 31 are arranged on the bottom surface 25 of the base 21 in four rows. Electrical cards with different specifications may be respectively inserted into the multi-card connector 2 for electrical connection.

The circuit board 40 is a printed circuit board on which a plurality of traces 41 and a connection interface 46 are formed. Each trace 41 has a first terminal 42 and a second terminal 43, both of which are disposed on a plane 40A of the circuit board 40. Each of the traces 41 is entirely disposed on the plane 40A of the circuit board 40. The first terminals 42 of the traces 41 are arranged in correspondence with the terminals of the multi-card connector such that the pins 31 of the plurality of terminals 30 are soldered to the first terminals 42 of the traces 41 when the bottom surface 25 of the common seat 20 contacts the circuit board 40. The connection interface 46 is a flexible printed circuit cable, which has one end formed with separately arranged golden finger interfaces 48 to be soldered to the second terminals 43 of the plurality of traces, and the other end formed with separately arranged golden finger interfaces 47 to be flexibly and electrically connected to an external interface, such as a flexible circuit board connector.

According to the above-mentioned structure, the invention can form a modularized and flexible connection interface according to the connection interface 46 of the flexible printed circuit cable, and the flexible connection interface can be flexibly and electrically connected to the external interface. In practice, the fixing portion 26 is screwed to a casing of a to-be-serially-connected electrical product, and then the connection interface 46 is electrically connected to a flexible circuit board connector on a mainboard of the electrical product. According to the flexible connection property, it is possible to eliminate the drawbacks and the cost of an additional board-soldering process for soldering the multi-card connector assembly to the mainboard.

Figure 5:
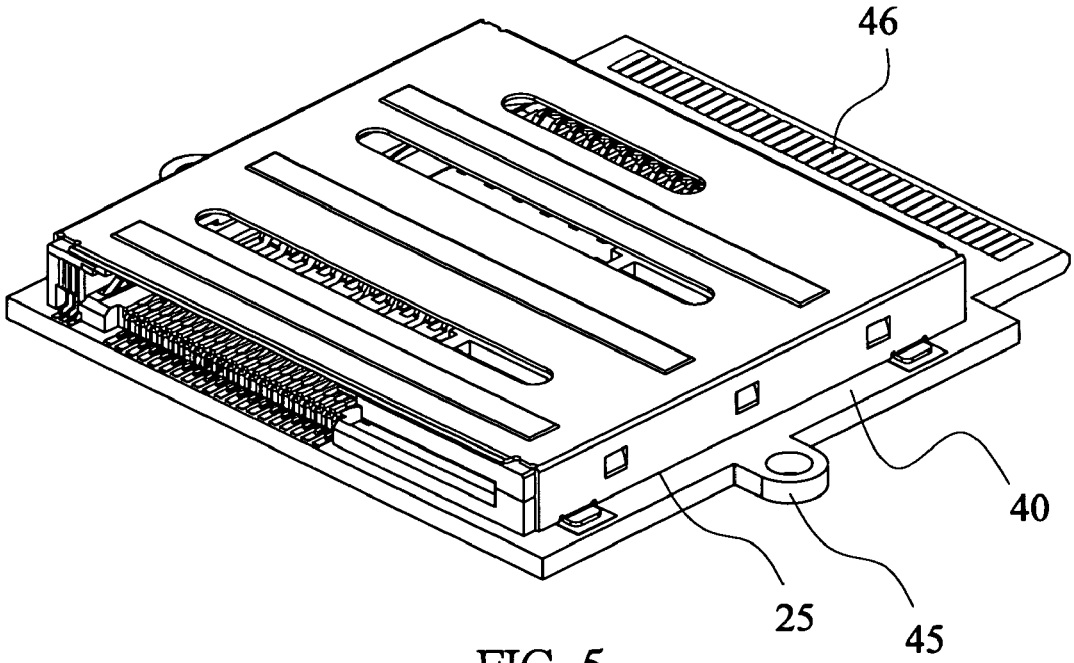
FIG. 5 is a pictorially assembled view showing a multi-card connector assembly according to a second embodiment of the invention.

As shown in FIG. 5, the second embodiment of the invention differs from the first embodiment in that the connection interface 46 is a module card interface having separately arranged golden fingers. Thus, the connection interface 46 can be flexibly inserted and connected to an external interface of a circuit board connector. In addition, the circuit board 40 has two fixing portions 45 at two sides. The fixing portion 45 is a horizontal plate formed with a through hole through which a screw may pass.

Figure 6:
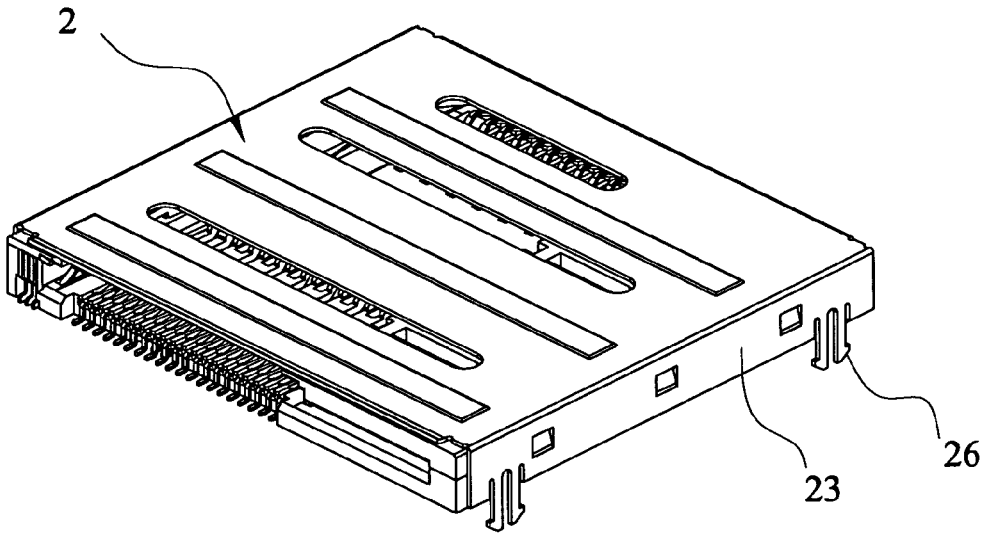
FIG. 6 is a pictorially exploded view showing a multi-card connector assembly according to a third embodiment of the invention.
Figure 6:
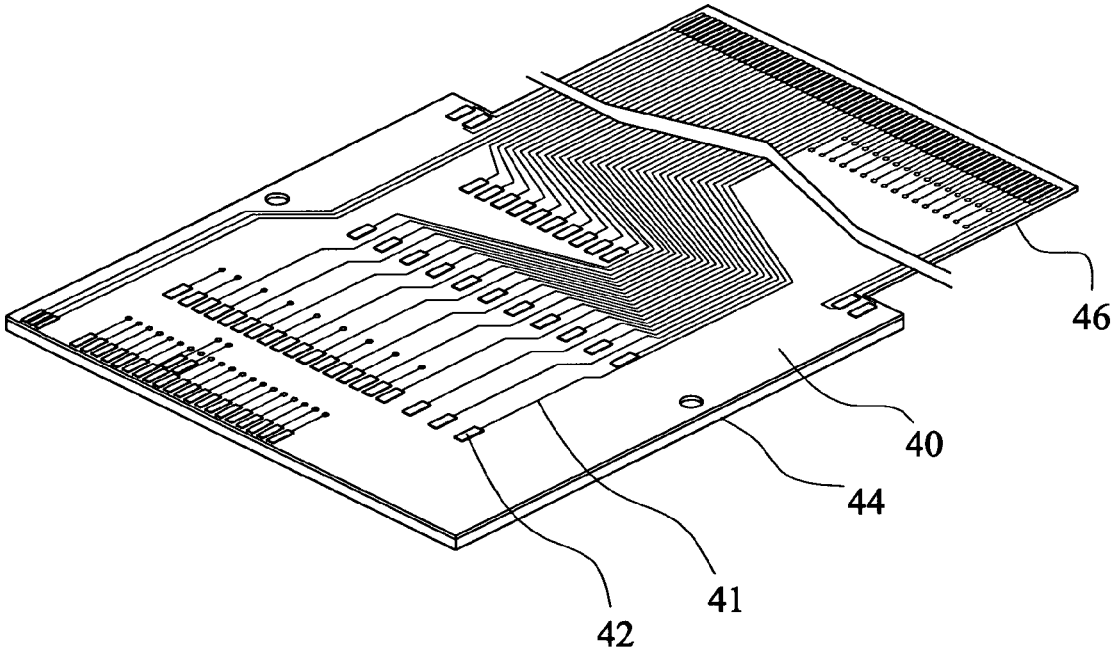
Figure 7:
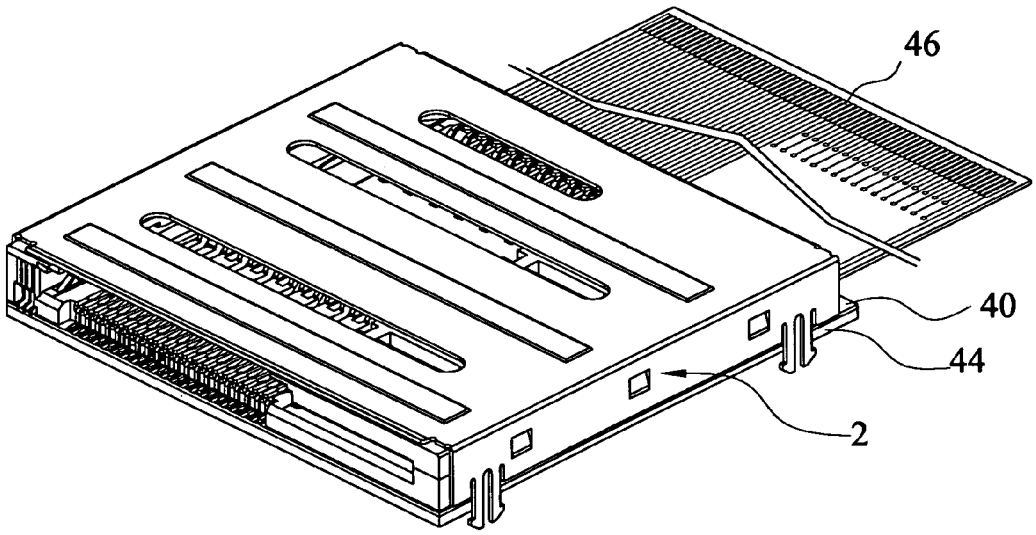
FIG. 7 is a pictorially assembled view showing the multi-card connector assembly according to the third embodiment of the invention.

As shown in FIGS. 6 and 7, the third embodiment differs from the first embodiment in that the circuit board 40 is a flexible printed circuit board, and the connection interface 46 is a flexible printed circuit cable integrally formed with the circuit board 40. Thus, the connection interface 46 does not have to be soldered to the circuit board 40. In addition, a hard reinforcement plate 44 is disposed on a bottom of the circuit board 40 so that the multi-card connector 2 can be soldered to the circuit board 40 in a more stable manner. Furthermore, the upper cover 23 of the multi-card connector is formed with the fixing portions 26 in the form of two hooking members at each of the two sides.

Figure 8:
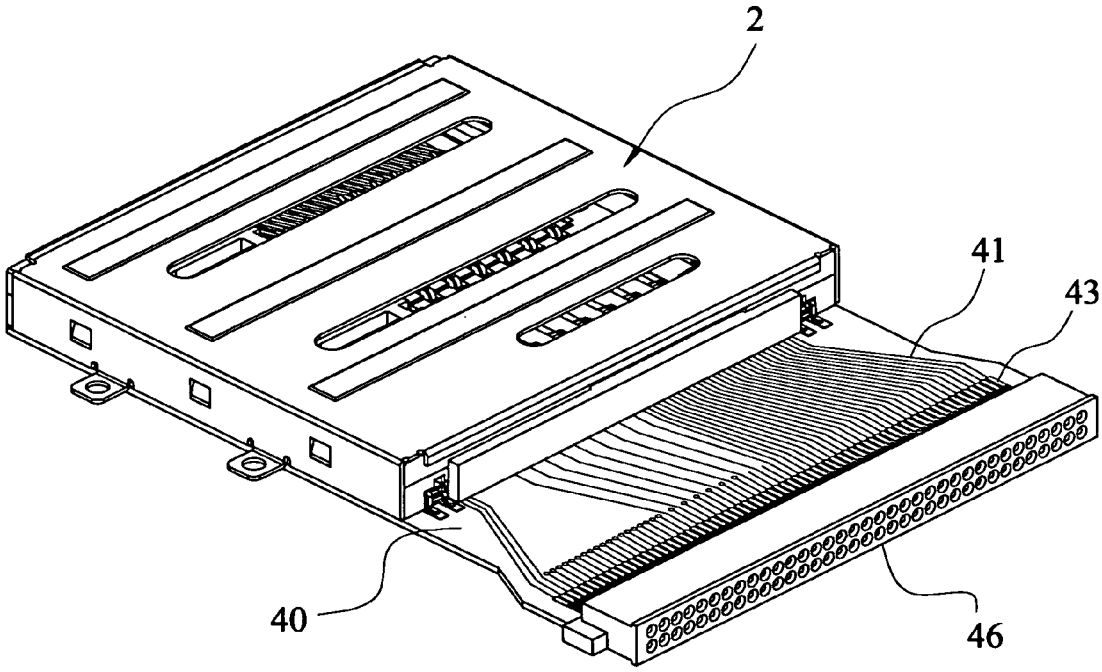
FIG. 8 is a pictorially assembled view showing a multi-card connector assembly according to a fourth embodiment of the invention.

As shown in FIG. 8, the fourth embodiment differs from the first embodiment in that the connection interface 46 is a PCMCIA (Personal Computer Memory Card International Association) interface.

The connection interface 46 of the embodiment is to be connected to a mainboard connector on a mainboard.

Figure 9:
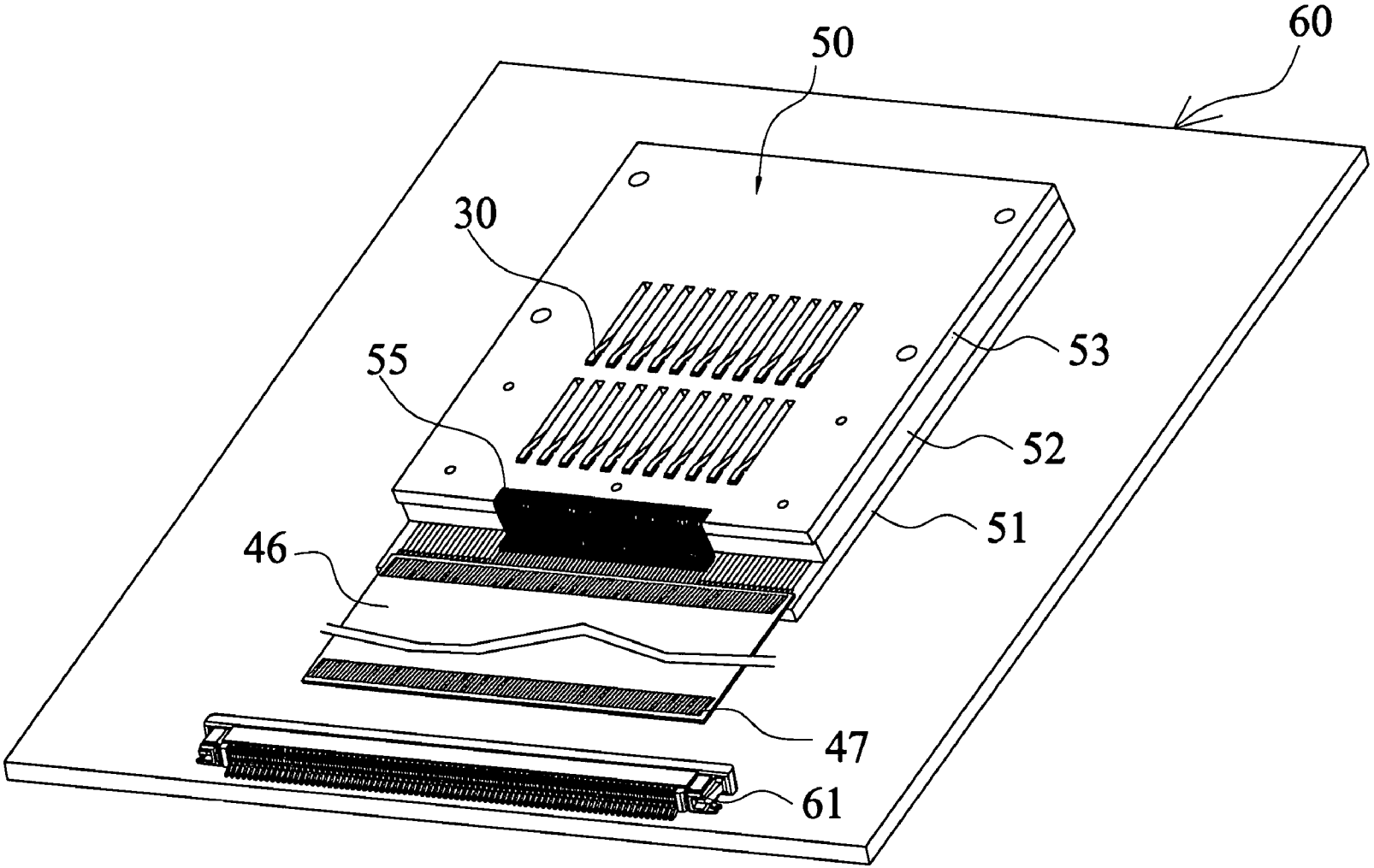
FIG. 9 is a pictorially assembled view showing a multi-card connector assembly according to a fifth embodiment of the invention.

As shown in FIG. 9, the fifth embodiment differs from the first embodiment in that the assembly further includes a mainboard 60 on which a mainboard connector 61 is disposed, and that the common seat 50 of the multi-card connector assembly is composed of a lower circuit board 51, a middle board 52 and an upper circuit board 53 such that a plurality of slots for receiving different electrical cards may be formed. The terminals 30 are respectively disposed on the lower circuit board 51 and the upper circuit board 53 of the base. The lower circuit board 51 is soldered to the connection interface 46 of the flexible printed circuit cable. Each of the upper and lower circuit boards 53 and 51 is formed with a plurality of traces. Each trace has one end electrically connected to a terminal 30, and the other end connected to the connection interface 46. One end of the connection interface 46 is formed with separately arranged golden finger interfaces 47 to be flexibly and electrically connected to the mainboard connector 61 on the mainboard 60. The traces on the upper circuit board 53 are connected to the lower circuit board 51 through metal pins 55. According to the above-mentioned structure, the multi-card connector assembly of the embodiment also can have the connection interface 46 with the flexible printed circuit cable. It is to be noted that the circuit board may be a flexible printed circuit board and integrally formed with the connection interface. Also, a hard reinforcement plate may be disposed on a bottom of the circuit board.

Figure 10:
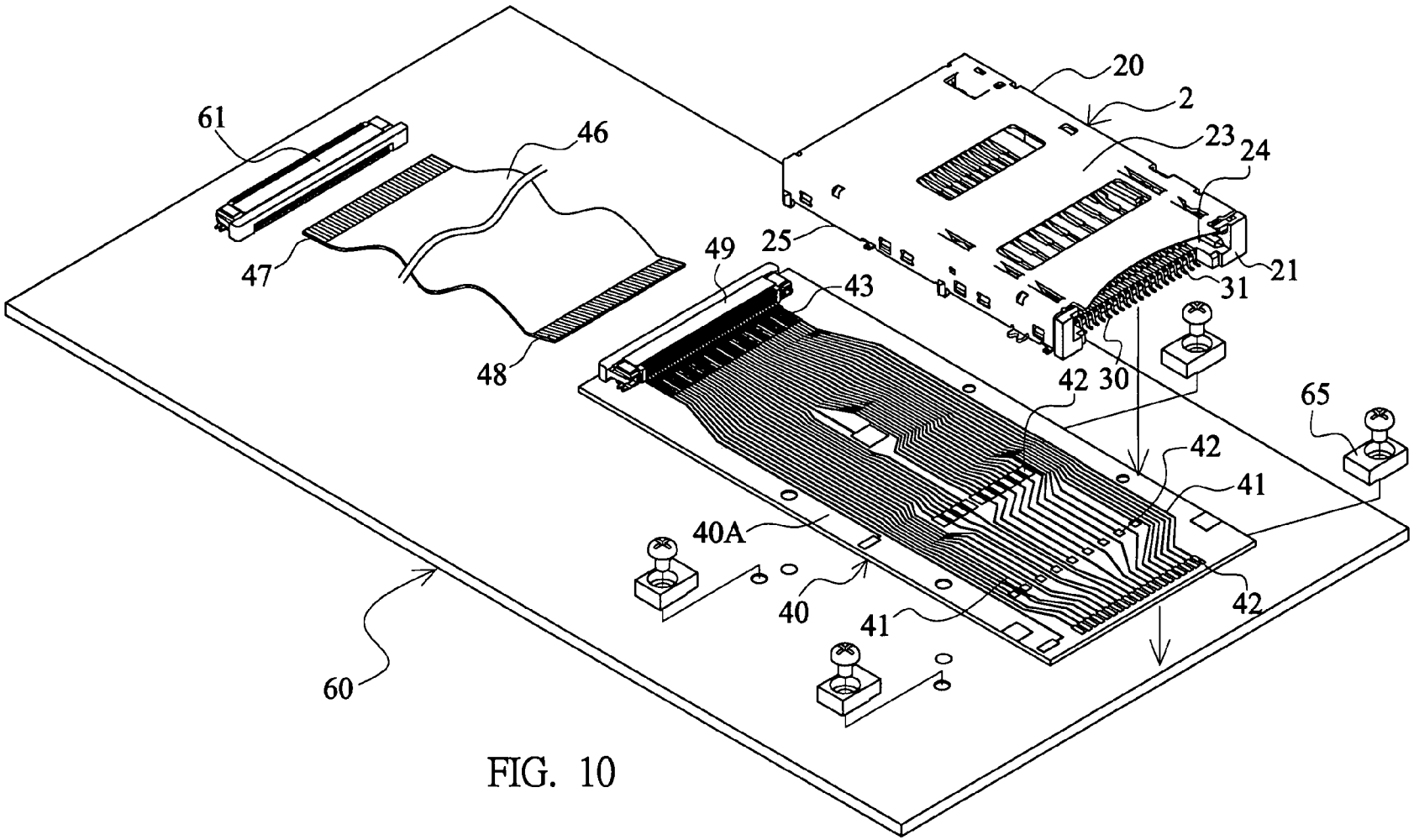
FIG. 10 is a pictorially exploded view showing a multi-card connector assembly according to a sixth embodiment of the invention.
Figure 11:
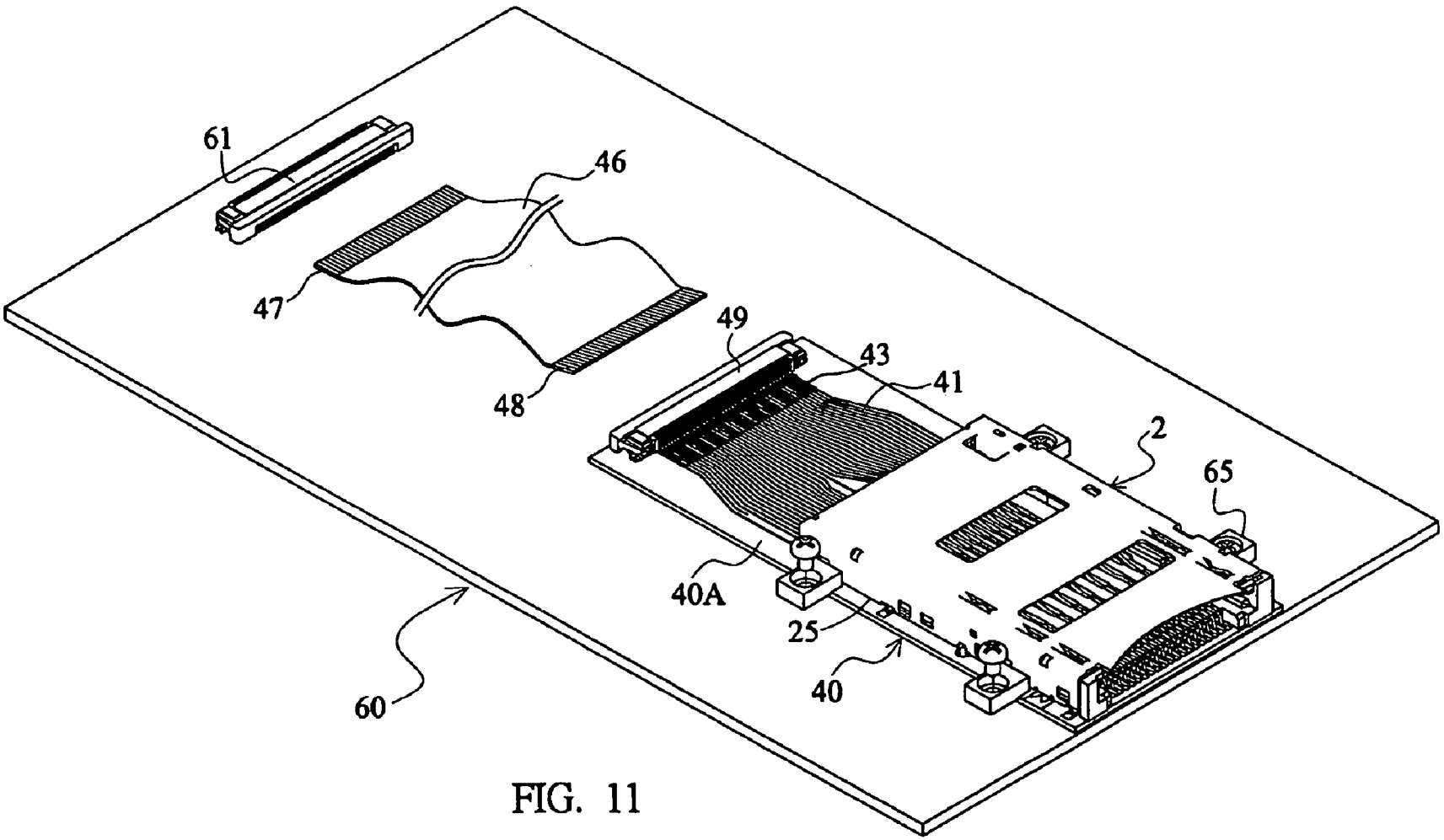
FIG. 11 is a pictorially assembled view showing the multi-card connector assembly according to the sixth embodiment of the invention.

Referring to FIGS. 10 and 11, a multi-card connector assembly according to the sixth embodiment of the invention includes a multi-card connector 2, a circuit board 40 and a mainboard 60.

An electrical mainboard connector 61 is disposed on the mainboard 60. The mainboard connector 61 may be a flexible circuit board connector.

Figure 12:
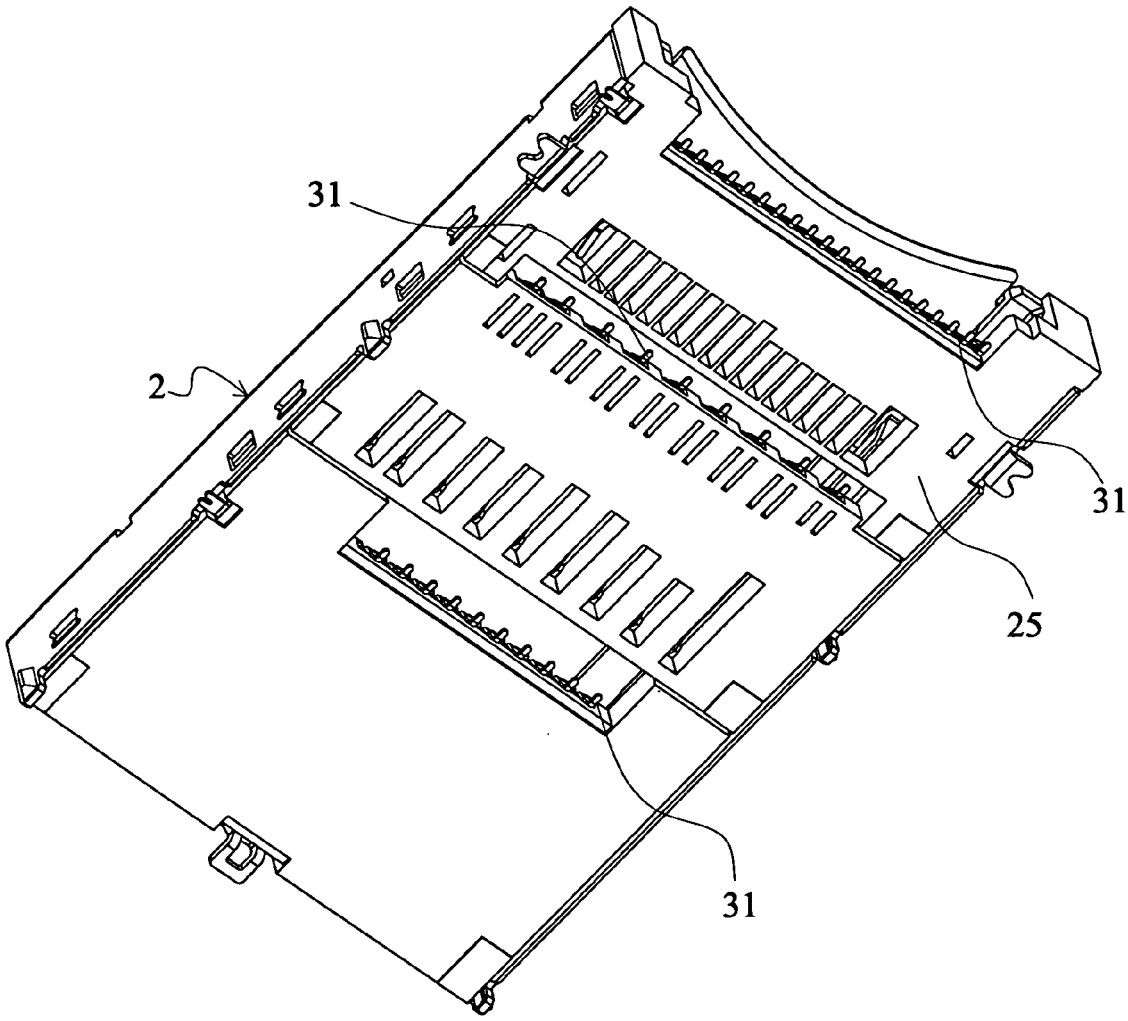
FIG. 12 is a pictorial bottom view showing the multi-card connector assembly according to the sixth embodiment of the invention.

The multi-card connector 2 includes a common seat 20, which is composed of a base 21 and an upper cover 23. Thus, a plurality of slots 24 into which different electrical cards can be individually inserted. The base 21 is made of a plastic material and has a bottom portion having a bottom surface 25. The upper cover 23 is an inverse-U shaped metal housing covering over the base 21. A plurality of terminals 30 is disposed on the common seat 20. Each terminal 30 has a pin 31 extending out of the bottom surface 25 of the base 21 of the common seat. As shown in FIG. 12, three rows of pins 31 are disposed on the bottom surface 25 of the base 21. Electrical cards with four different specifications may be individually inserted into the multi-card connector assembly of this embodiment.

The circuit board 40 is a printed circuit board, on which a plurality of traces 41, a connection interface 46 and an electrical circuit-board connector 49 are disposed. Each trace 41 has a first terminal 42 and a second terminal 43, both of which are disposed on a plane 40A of the circuit board 40. Each of the traces 41 is entirely disposed on the plane 40A of the circuit board 40. The first terminals 42 of the traces 41 are arranged in correspondence with the pins 31 of the terminals of the multi-card connector. Thus, the pins 31 of the plurality of terminals 30 are soldered to the first terminals 42 of the traces 41 when the bottom surface 25 of the common seat 20 contacts the circuit board 40. The circuit-board connector 49 is a flexible circuit board connector having terminals bonded to the second terminals 43 of the traces. The connection interface 46 is a flexible printed circuit cable, which has one end formed with separately arranged golden finger interfaces 48 to be soldered to the circuit-board connector 49, and the other end formed with separately arranged golden finger interfaces 47 to be flexibly and electrically connected to the mainboard connector on the mainboard 60. In addition, the circuit board is mounted on the mainboard 60 through four fixing members 65. In this embodiment, the bottom portion of the common seat 20 is in direct contact with the circuit board 40, the first terminals 42 and the second terminals 43 are located on the same plane, and the circuit board 40 is interposed between the common seat 20 and the mainboard 60. Also, the pins 31 extend in a direction substantially parallel to the bottom surface 25 of the bottom portion and the plane 40A of the circuit board 40.

The circuit board 40 of this embodiment is further provided with the circuit-board connector 49 to be connected to the connection interface 46 more easily so that the manufacturing processes may be simplified.

Figure 13:
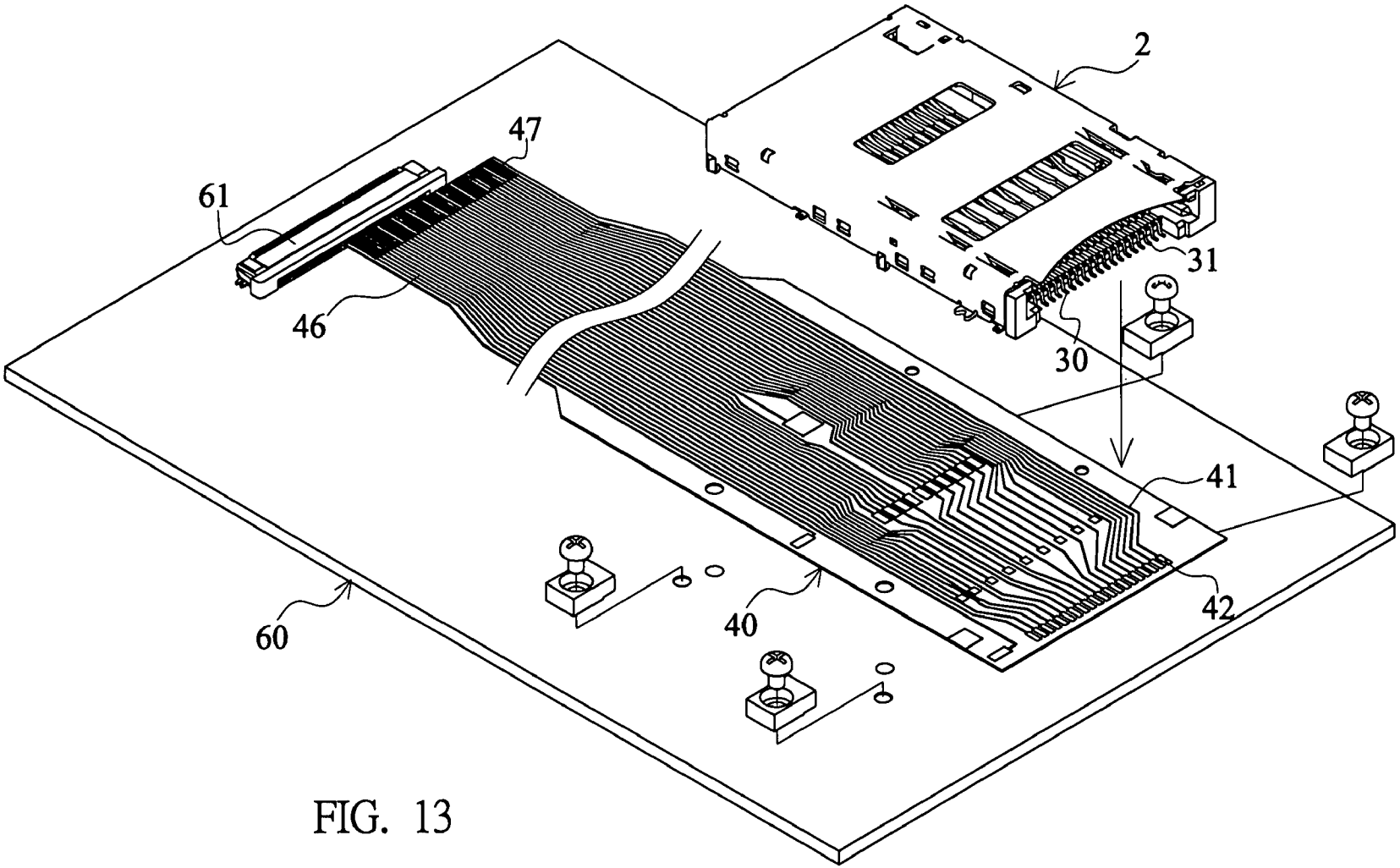
FIG. 13 is a pictorially exploded view showing a multi-card connector assembly according to a seventh embodiment of the invention.
Figure 14:
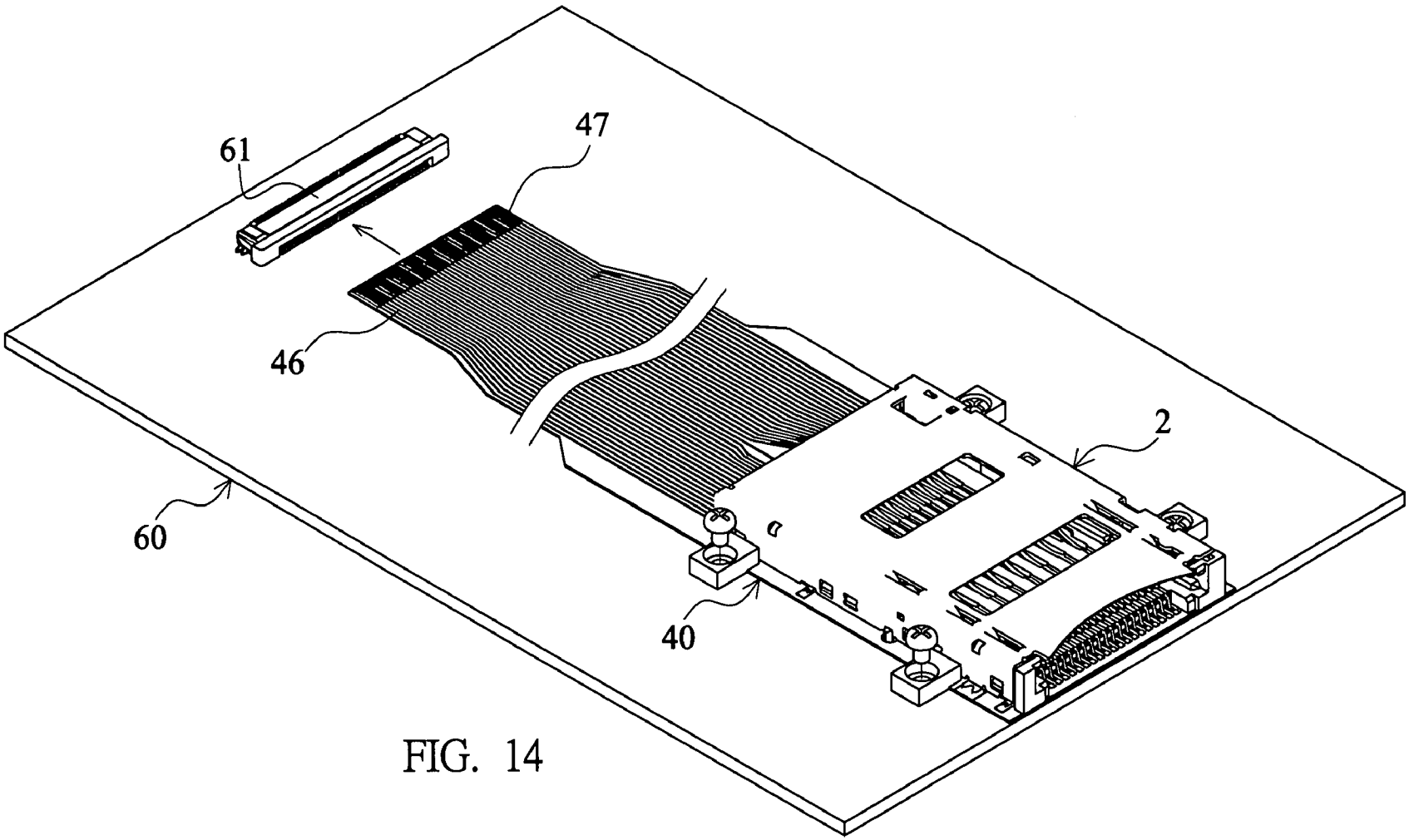
FIG. 14 is a pictorially assembled view showing the multi-card connector assembly according to the seventh embodiment of the invention.

Referring to FIGS. 13 and 14, a multi-card connector assembly according to the seventh embodiment of the invention includes a multi-card connector 2, a circuit board 40 and a mainboard 60.

An electrical mainboard connector 61 is disposed on the mainboard 60, and the mainboard connector 61 may be a flexible circuit board connector.

The multi-card connector 2 is the same as that of the sixth embodiment.

The circuit board 40 is a flexible printed circuit board on which a plurality of traces 41, a connection interface 46, and a circuit-board connector 49 are disposed. Each trace 41 has a first terminal 42. The first terminals 42 of the traces 41 are arranged in correspondence with the pins 31 of the terminals of the multi-card connector. Thus, the pins 31 of the plurality of terminals 30 are soldered to the first terminals 42 of the traces 41 when the bottom surface 25 of the common seat 20 contacts the circuit board 40. The connection interface 46 and the circuit board are integrally formed. Each trace 41 on the circuit board extends to separately arranged golden finger interfaces 47 formed at an outer end of the connection interface 46. The golden finger interfaces 47 of the connection interface 46 may be flexibly and electrically connected to the mainboard connector 61 on the mainboard 60.

Figure 15:
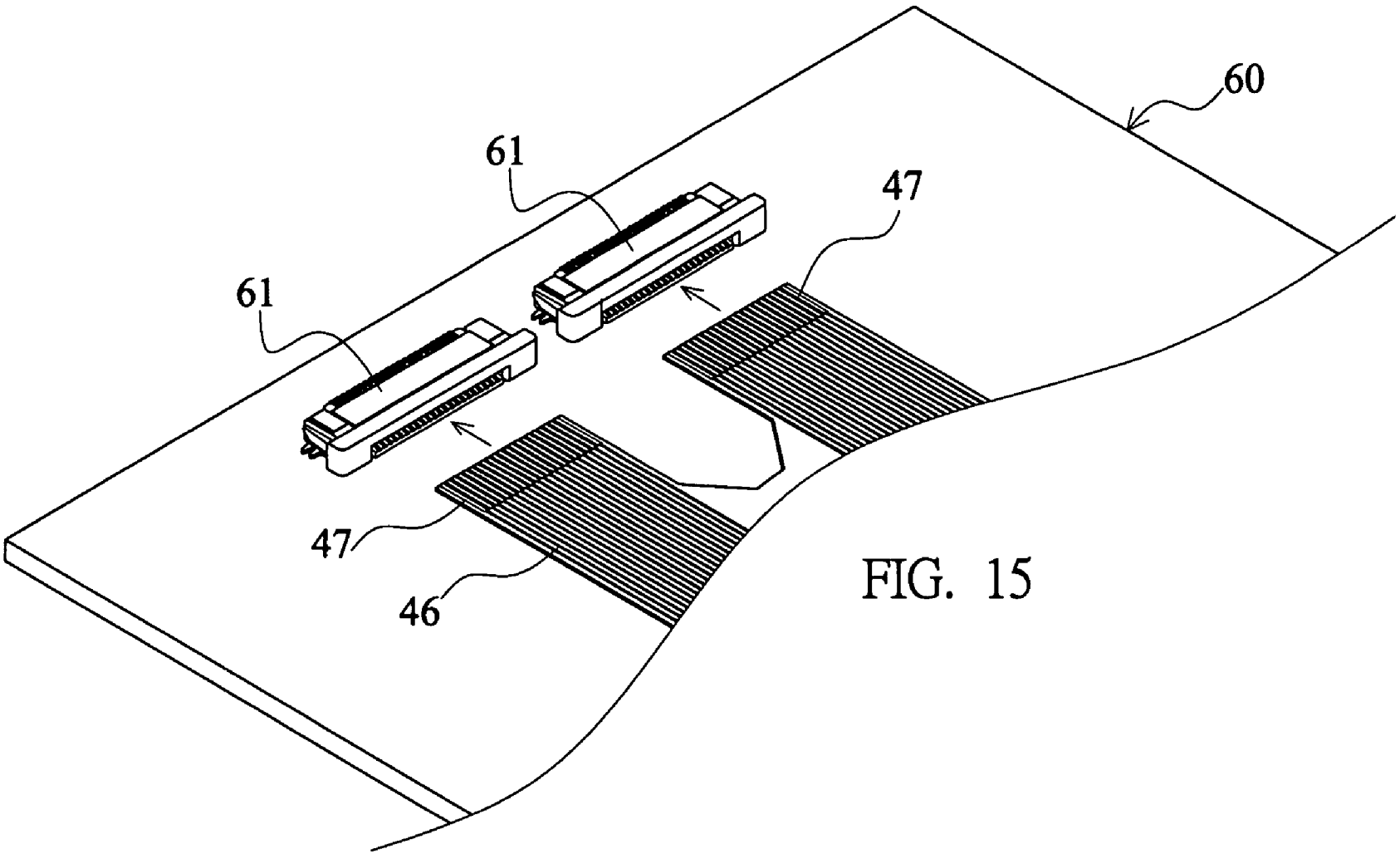
FIG. 15 is a pictorial view showing a multi-card connector assembly according to an eight embodiment of the invention.

As shown in FIG. 15, the eighth embodiment of the invention is almost the same as the seventh embodiment except that two mainboard connectors 61 having fewer terminals are disposed on the mainboard 60, and the connection interface 46 is formed with two golden finger interfaces 47 to be respectively connected to the two mainboard connectors 61.

The invention has the following advantages.

1. The problems of the multi-card connector to be soldered to the circuit board and of testing the multi-card connector can be solved by the manufacturer. Thus, the multi-card connector assembly to be transferred to the downstream customer can be free from any defect.

2. If the miss of soldering and poor test results occur when the multi-card connector is soldered to the circuit board, the manufacturer may easily repair, solder and test again because only the single connector has to be soldered.

3. Utilizing the connection interface 46 of the flexible printed circuit cable, the invention can achieve a flexible and small connector assembly, which can be conveniently and flexibly electrically connected to the external interface. The prior art multi-card connector, however, never achieves the effect because the typical flexible connection between male and female connectors or between the slot and an inserted module card still need very precisely alignments, and the connection cannot be made if the positions are slightly deviated from the correct ones.

4. Because the invention provides a connection interface with a flexible circuit cable, it is possible to flexibly electrically connect the assembly to the external interface without the need of being soldered to another connector. Thus, the manufacturing cost can be smaller than that in the prior art, in which a flexible circuit board connector to be connected to a flexible printed circuit cable is soldered to the printed circuit board.

5. Because the invention is formed with a flexible circuit board, which is integrally formed with a connection interface of a flexible printed circuit cable and traces for connecting the flexible circuit board to the connection interface, the connection interface of the flexible printed circuit cable does not have to be soldered to another printed circuit board, and the manufacturing cost can be reduced.

While the invention has been described by way of examples and in terms of preferred embodiments, it is to be understood that the invention is not limited to the disclosed embodiments. To the contrary, it is intended to cover various modifications. Therefore, the scope of the appended claims should be accorded the broadest interpretation so as to encompass all such modifications.

What is claimed is:

1. A multi-card connector assembly, comprising:

a mainboard on which a mainboard connector is disposed;

a multi-card connector disposed on the mainboard, the multi-card connector comprising a common seat formed with a plurality of slots into which different electrical cards may be inserted, and a plurality of terminals disposed on the common seat, wherein each of the terminals has a pin extending out of a bottom surface of a bottom portion of the common seat; and a circuit board, on which a plurality of traces and a connection interface are formed, wherein each of the traces has a first terminal and a second terminal, the first terminals of the traces are arranged in correspondence with the pins of the terminals of the multi-card connector such that the pins of the terminals are respectively soldered to the first terminals of the traces, the connection interface is electrically connected to the second terminals of the traces and is flexibly and electrically connected to the mainboard connector on the mainboard, the bottom portion of the common seat is in direct contact with the circuit board, and the first terminals and the second terminals are located on the same plane.

2. The assembly according to claim 1, wherein the connection interface is a flexible printed circuit cable.

3. The assembly according to claim 1, wherein the connection interface is a module card interface having separately arranged golden fingers.

4. The assembly according to claim 1, wherein the circuit board has a fixing portion at one side.

5. The assembly according to claim 1, wherein the multi-card connector has a fixing portion at one side.

6. The assembly according to claim 1, wherein the connection interface is a PCMCIA interface.

7. The assembly according to claim 1, wherein a circuit-board connector is disposed on the circuit board, the circuit-board connector is connected to the second terminals of the traces, and the connection interface is electrically connected to the circuit-board connector.

8. The assembly according to claim 1, wherein the circuit board is interposed between the common seat and the mainboard.

9. The assembly according to claim 1, wherein the circuit board is a flexible printed circuit board, and the connection interface is a flexible printed circuit cable integrally formed with the circuit board.

10. The assembly according to claim 9, further comprising a hard reinforcement plate disposed on a bottom of the circuit board.

11. A multi-card connector assembly, comprising:

a mainboard on which a mainboard connector is disposed;

a circuit board on which a plurality of traces and a flexible connection interface are formed, wherein each of the traces has a first terminal and a second terminal, and the connection interface is a flexible printed circuit cable, is electrically connected to the second terminals of the traces, and is flexibly and electrically connected to the mainboard connector on the mainboard;

a common seat having a plurality of slots into which different electrical cards can be inserted; and a plurality of terminals disposed on the common seat, wherein the terminals are respectively electrically connected to the first terminals of the traces of the circuit board, the common seat is in direct contact with the circuit board, and the first terminals and the second terminals are located on the same plane.

12. The assembly according to claim 11, wherein the circuit board is interposed between the common seat and the mainboard.

13. The assembly according to claim 11, wherein the circuit board is a flexible printed circuit board and is integrally formed with the connection interface.

14. The assembly according to claim 13, further comprising a hard reinforcement plate disposed on a bottom of the circuit board.

15. A multi-card connector assembly, comprising:

a mainboard on which a mainboard connector is disposed;

a multi-card connector disposed on the mainboard the multi-card connector comprising a common seat formed with a plurality of slots into which different electrical cards may be inserted, and a plurality of terminals disposed on the common seat, wherein each of the terminals has a pin extending out of a bottom surface of a bottom portion of the common seat; and a circuit board, on which a plurality of traces and a connection interface are formed, wherein each of the traces has a first terminal and a second terminal, the first terminals of the traces are arranged in correspondence with the pins of the terminals of the multi-card connector such that the pins of the terminals are respectively soldered to the first terminals of the traces, the connection interface is electrically connected to the second terminals of the traces and is flexibly and electrically connected to the mainboard connector on the mainboard, the bottom portion of the common scat is in direct contact with the board and the pins extend in a direction substantially parallel to the bottom surface of the bottom portion and a plane of the circuit board.

* * * * *